US009869498B2

(12) United States Patent
Matsuoka et al.

(10) Patent No.: US 9,869,498 B2
(45) Date of Patent: Jan. 16, 2018

(54) REFRIGERANT CHARGING METHOD FOR REFRIGERATION DEVICE HAVING CARBON DIOXIDE AS REFRIGERANT

(71) Applicant: Daikin Industries, Ltd., Osaka-shi, Osaka (JP)

(72) Inventors: Hiromune Matsuoka, Sakai (JP); Toshiyuki Kurihara, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 524 days.

(21) Appl. No.: 13/860,470

(22) Filed: Apr. 10, 2013

(65) Prior Publication Data

US 2013/0219928 A1 Aug. 29, 2013

Related U.S. Application Data

(63) Continuation of application No. 12/374,166, filed as application No. PCT/US2007/064187 on Jul. 18, 2007, now Pat. No. 8,479,526.

(30) Foreign Application Priority Data

Jul. 21, 2006 (JP) ..... 2006-199707

(51) Int. Cl.
*F25B 45/00* (2006.01)
*F25B 9/00* (2006.01)
*F25B 13/00* (2006.01)

(52) U.S. Cl.
CPC ..... *F25B 45/00* (2013.01); *F25B 9/008* (2013.01); *F25B 13/00* (2013.01);
(Continued)

(58) Field of Classification Search
CPC ..... F25B 45/00; F25B 9/0008
(Continued)

(56) References Cited

U.S. PATENT DOCUMENTS 2,821,259 A * 1/1958 Garretson ..... 180/69.5
3,054,270 A * 9/1962 Huston ..... 62/50.2
(Continued)

FOREIGN PATENT DOCUMENTS

JP 53-13255 2/1978
JP 54-87908 A 7/1979
(Continued)

OTHER PUBLICATIONS

Tomczyk, John Charging Air Conditioning Systems Using a Superheat Curve. Refrgieration Service and Contracting; Apr. 1998; 66, 4; p. 18 [retrieved from ProQuest Central database].*
(Continued)

*Primary Examiner* — Len Tran
*Assistant Examiner* — Alexis Cox
(74) *Attorney, Agent, or Firm* — Global IP Counselors, LLP

(57) ABSTRACT

A refrigerant charging method includes installing, cooling, confirming, and moving steps. In the installing step, a refrigeration device is installed on site. In the cooling step, a container is cooled to 31° C. or below using a cooling medium. In the confirming step, it is confirmed that the container has reached 31° C. or below. In the moving step, the refrigerant is moved to the intended charging space from the container upon confirming that the container has reached 31° C. or below via the cooling step. When moving the refrigerant from the container to the intended charging space, first, refrigerant that is in a gas phase within the container is moved into the intended charging space, whereupon refrigerant that is in a liquid phase within the container is moved into the intended charging space.

2 Claims, 4 Drawing Sheets

(52) U.S. Cl.
CPC ..... *F25B 2309/061* (2013.01); *F25B 2313/02741* (2013.01); *F25B 2345/001* (2013.01); *F25B 2400/01* (2013.01)

(58) Field of Classification Search
USPC ..... 62/77, 292, 149, 165, 48.1, 50.2
See application file for complete search history.

(56) References Cited

U.S. PATENT DOCUMENTS

| | | | | |
|---|---|---|---|---|
| 3,857,245 | A * | 12/1974 | Jones | 60/651 |
| 4,045,972 | A | 9/1977 | Tyree, Jr. | |
| 5,193,349 | A * | 3/1993 | Laverman et al. | 62/64 |
| 5,802,859 | A * | 9/1998 | Zugibe | 62/125 |
| 8,176,752 | B2 | 5/2012 | Schiefelbein et al. | |
| 2006/0010888 | A1* | 1/2006 | Suharno et al. | 62/149 |
| 2006/0010898 | A1* | 1/2006 | Suharno et al. | 62/292 |
| 2006/0101835 | A1 | 5/2006 | Meldahl et al. | |

FOREIGN PATENT DOCUMENTS

| | | | |
|---|---|---|---|
| JP | 56-68699 | U | 10/1979 |
| JP | 56-70760 | U | 11/1979 |
| JP | 56-91164 | A | 7/1981 |
| JP | 5-93559 | A | 4/1993 |
| JP | 05093559 | A * | 4/1993 |
| JP | 6-501768 | A | 2/1994 |
| JP | 11-132602 | A | 5/1999 |
| JP | 2001-74342 | A | 3/2001 |
| JP | 2001-518596 | A | 10/2001 |
| JP | 2002-235971 | A | 8/2002 |
| JP | 2002-372346 | A | 12/2002 |
| JP | 2003-279199 | A | 10/2003 |
| JP | 2004-77034 | A | 3/2004 |
| JP | 2005-76939 | A | 3/2005 |
| JP | 2005-114184 | A | 4/2005 |
| JP | 2006-10117 | A | 1/2006 |
| KR | 1993-005667 | B1 | 6/1993 |
| KR | 10-2005-0121428 | A | 12/2005 |
| WO | 89/07227 | A1 | 8/1989 |
| WO | 92/06325 | A1 | 4/1992 |
| WO | 99/02916 | A1 | 1/1999 |

OTHER PUBLICATIONS

Compressori Frigoriferi Per Co2; Pisano; Officine Mario Dorin S.P.A.; from Internet, Jun. 15, 2012.

News Article, Co2 Refrigerant: The Transcritical Cycle; Jan. 20, 2004; from Internet, Jun. 15, 2012.

The Use of Carbon Dioxide in Refrigeration and Heat Pump Systems; Pisano; Officine Mario Dorin S.P.A.

European Search Report of corresponding EP Application No. 07 79 0941.4 dated May 22, 2014.

* cited by examiner

Fig. 18 Pressure-Enthalpy Diagram for Refrigerant 744 (Carbon Dioxide)

REFRIGERANT CHARGING METHOD FOR REFRIGERATION DEVICE HAVING CARBON DIOXIDE AS REFRIGERANT

CROSS-REFERENCE TO RELATED APPLICATIONS

This application is a continuation application of U.S. patent application Ser. No. 12/374,166 filed on Jan. 16, 2009, which is a National Stage application of International Patent Application No. PCT/JP2007/064187 filed on Jul. 18, 2007. The entire disclosure of U.S. patent application Ser. No. 12/374,166 is hereby incorporated herein by reference.

This application claims priority to Japanese Patent Application No. 2006-199707, filed in Japan on Jul. 21, 2006, the entire contents of which are hereby incorporated herein by reference.

TECHNICAL FIELD

The present invention relates to a refrigerant charging method for a refrigeration device in which carbon dioxide is used as a refrigerant, and particularly to a refrigerant charging method performed when the refrigerant is charged in the refrigeration device on-site after an indoor unit and an outdoor unit have been connected by interconnecting piping.

BACKGROUND ART

Fluorocarbons (CFCs) have conventionally been the main refrigerant used in refrigeration devices; however, developments have been made over the past several years in regard to technologies in which carbon dioxide is used as a refrigerant. Carbon dioxide refrigeration cycles, such as disclosed in Japanese Laid-open Patent Publication No. 2001-74342, are widely known in the field of air conditioners used in automotive vehicles, and commercial products in which carbon dioxide is used as a refrigerant are used in the field of hot-water-supplying devices.

SUMMARY

In hot-water-supplying devices that are already on the market, the task of charging refrigerant (carbon dioxide) into the refrigeration cycle is performed at a manufacturing plant belonging to the manufacturer. Hot-water-supplying devices in which carbon dioxide is used as a refrigerant are not regarded to be in widespread use at present, and there is little demand to reduce the time required to perform the refrigerant charging task to facilitate mass production, even in manufacturing plants.

However, should such hot-water-supplying devices come into more widespread use, issues concerning their efficiency will arise.

Currently, in office air conditioners and other equipment in which fluorocarbons are used as refrigerants, interconnecting refrigerant piping for connecting the indoor and outdoor units is fitted on-site in the building in which the air conditioners are to be installed, and often the refrigerant charging task is performed on-site. Even in cases in which the indoor and outdoor air conditioning machines have been charged in advance with a predetermined amount of refrigerant, additional refrigerant charging tasks will be performed on site, depending on the length of the interconnecting refrigerant piping that has been fitted on-site, as well as other factors. In on-site refrigerant charging tasks, a method is adopted in which the space inside the piping is evacuated using a vacuum pump or the like, and a refrigerant is delivered from a cylinder into the piping.

However, when the on-site refrigerant charging task involves using the same procedure for conventional chlorofluorocarbons but for a carbon dioxide refrigerant, there will be incidences of faults related to, e.g., an increase in the time required for the task, or an inability for the air conditioning operation to commence for a certain period of time after charging is completed.

An object of the present invention is to provide a refrigerant charging method for a refrigeration device in which carbon dioxide is used as a refrigerant, wherein it is possible to reduce the time required for refrigerant charging and the time between refrigerant charging and recommencing operation.

Refrigeration devices such as a hot-water-supplying device having a refrigeration cycle in which a carbon dioxide refrigerant is used are currently charged with the refrigerant at a manufacturing plant or another production site belonging to a manufacturer. However, refrigeration devices such as office air conditioners are not charged with carbon dioxide refrigerant at the locations at which the devices are installed. In other words, at present, carbon dioxide refrigerants are only widely used in refrigeration devices that are not charged at the installation location; the only refrigeration devices sold commercially have been completely charged with the refrigerant at the manufacturing site.

However, the refrigerant charging task needs to be optimized and efficient when the use of a carbon dioxide refrigerant is considered for application in office air conditioners or other refrigeration devices where it is common for interconnecting refrigerant piping for connecting indoor and outdoor units to be fitted in the buildings where the device is installed, and charging of the refrigerant to be performed on-site.

Therefore, the present inventors conducted a variety of investigations into charging refrigeration devices with a carbon dioxide refrigerant. First, when the refrigerant is to be charged into the intended charging space of a refrigeration device having carbon dioxide as a refrigerant, and the temperature of a cylinder for discharging and supplying the refrigerant exceeds 31° C., the carbon dioxide refrigerant inside the cylinder will reach a supercritical state. When the refrigerant starts to be supplied from the cylinder into the intended charging space, which is substantially in a vacuum state, then in some instances the amount of heat held by the refrigerant will cause the pressure to decrease sharply, whereby the refrigerant will change into a "dry ice" state (solid state). Specifically, when the specific enthalpy of the refrigerant when entering the intended charging space is less than 430 kJ/kg, an abrupt drop in the pressure can cause the refrigerant to change to a solid state. If the refrigerant changes to a solid state while in the intended charging space, the trailing refrigerant flowing into the space will be obstructed by the solidified refrigerant and the time until the charging is completed will increase, or more time will elapse after charging until the operation can recommence (until the solid state refrigerant dissolves).

A refrigerant charging method according to a first aspect is a refrigerant charging method used when a refrigeration device having an indoor unit and an outdoor unit and having carbon dioxide used as a refrigerant is installed on-site, the indoor unit and the outdoor unit are connected using interconnecting piping, and the refrigerant is subsequently charged on-site into the refrigeration device. The refrigerant charging method comprises an installing step, a cooling step, a confirming step, and a moving step. In the installing step, a refrigeration device is installed on site having an indoor unit and an outdoor unit and having carbon dioxide used as a refrigerant, the indoor unit and the outdoor unit being connected using interconnecting piping, and the refrigerant being subsequently charged on-site into the refrigeration device. In the cooling step, a container is cooled to 31° C. or below using a cooling medium, the container containing the refrigerant and supplying the refrigerant to a space in the refrigeration device intended to be charged by the refrigerant. In the confirming step, it is confirmed that the container has reached 31° C. or below. In the moving step, the refrigerant is moved to the intended charging space from the container upon confirming that the container has reached 31° C. or below via the cooling step. When moving the refrigerant from the container to the intended charging space, first, refrigerant that is in a gas phase within the container is moved into the intended charging space, whereupon refrigerant that is in a liquid phase within the container is moved into the intended charging space.

Refrigeration devices such as a hot-water-supplying device having a refrigeration cycle in which a carbon dioxide refrigerant is used are currently charged with the refrigerant at a manufacturing plant belonging to a manufacturer. However, refrigeration devices such as office air conditioners are not charged with carbon dioxide refrigerant at the locations at which the devices are installed. In other words, at present, carbon dioxide refrigerants are only widely used in refrigeration devices that are not charged at the installation location; the only refrigeration devices sold commercially have been completely charged with the refrigerant at the manufacturing site.

However, the refrigerant charging task needs to be optimized and efficient when the use of a carbon dioxide refrigerant is considered for application in refrigeration devices such as commercial air conditioners where it is common for interconnecting refrigerant piping for connecting indoor and outdoor units to be fitted in the buildings where the device is installed, and charging of the refrigerant to be performed on-site.

Therefore, the present inventors conducted a variety of investigations into charging refrigeration devices with a carbon dioxide refrigerant. First, when the refrigerant is to be charged into the intended charging space of a refrigeration device having carbon dioxide as a refrigerant, and when the refrigerant starts to be supplied from the cylinder into the intended charging space, which is in substantially a vacuum state, then in some instances the amount of heat held by the refrigerant will cause the pressure to decrease sharply, whereby the refrigerant will change into a "dry ice" state (solid state). If the refrigerant changes to a solid state while in the intended charging space, the trailing refrigerant flowing into the space will be obstructed by the solidified refrigerant and the time until the charging is completed will increase, or more time will elapse after charging until the operation can recommence (until the solid state refrigerant dissolves).

In order to solve the aforedescribed problems, according to the refrigerant charging method of the first aspect, a cooling step is provided before the refrigerant charging (moving) step. In the cooling step, a container that supplies the refrigerant to the space in the refrigeration device intended to be charged by the refrigerant is cooled to 31° C. or below. As a result, the refrigerant inside the cylinder will not reach the supercritical state, and will be in a liquid phase or gas phase. Moreover, the refrigerant that is in a gas phase inside the container will first be caused to move into the space intended to be charged by the refrigerant; therefore, it will be substantially impossible for the refrigerant to change to the solid state even if the intended charging space is in a vacuum state and the refrigerant experiences an abrupt drop in pressure. Refrigerant that is in a liquid phase will similarly not change to a solid state in the intended charging space because the refrigerant that is in a liquid phase inside the cylinder will enter the intended charging space after the refrigerant that is in a gas phase inside the container has entered the intended charging space and the pressure therein has risen to some extent.

Thus, according to the refrigerant charging method of the first aspect, it is possible to prevent the incidence of circumstances under which refrigerant that has entered the intended charging space from the container changes into a solid state during the charging process, and to minimize the incidence of faults related to, e.g., the solid-state refrigerant becoming an obstruction, as well as an increase in the charging time or the time following refrigerant charging until operation recommences.

The refrigerant charging method according to a second aspect is a refrigerant charging method for a refrigeration device and comprises a cooling step, a confirming step, and a moving step. In the cooling step, a container is cooled to 31° C. or below using a cooling medium, the container containing a carbon dioxide refrigerant and supplying the refrigerant to a space in the refrigeration device intended to be charged by the refrigerant. In the refrigerant charging step, the refrigerant is moved to the intended charging space from the container that has reached 31° C. or below via the cooling step. In the confirming step, it is confirmed that the container has reached 31° C. or below. In the moving step, the refrigerant is moved to the intended charging space from the container upon confirming that the container has reached 31° C. or below via the cooling step. When moving the refrigerant from the container to the intended charging space, first, refrigerant that is in a gas phase within the container is moved into the intended charging space, whereupon refrigerant that is in a liquid phase within the container is moved into the intended charging space.

Refrigeration devices such as a hot-water-supplying device having a refrigeration cycle in which a carbon dioxide refrigerant is used are currently charged with the refrigerant at a manufacturing plant or another production site belonging to a manufacturer. However, refrigeration devices such as office air conditioners are not charged with carbon dioxide refrigerant at the locations at which the devices are installed. In other words, at present, carbon dioxide refrigerants are only widely used in refrigeration devices that are not charged at the installation location; the only refrigeration devices sold commercially have been completely charged with the refrigerant at the manufacturing site. At present, refrigeration devices having carbon dioxide refrigerants such as hot-water-supplying devices are not mass-produced, and there is little demand to reduce the time required to perform the refrigerant charging task to facilitate mass production.

However, the refrigerant charging task needs to be optimized and efficient in such instances as when the use of a carbon dioxide refrigerant is considered for application in office air conditioners or other refrigeration devices where it is common for interconnecting refrigerant piping for connecting indoor and outdoor units to be fitted in the buildings where the device is installed, and charging of the refrigerant to be performed on-site; or when refrigeration devices are mass-produced at a production site.

Therefore, the present inventors conducted a variety of investigations into charging refrigeration devices with a carbon dioxide refrigerant. First, when the refrigerant is to be charged into the intended charging space of a refrigeration device having carbon dioxide as a refrigerant, and when the refrigerant starts to be supplied from the cylinder into the intended charging space, which is in substantially a vacuum state, then in some instances the amount of heat held by the refrigerant will cause the pressure to decrease sharply, whereby the refrigerant will change into a "dry ice" state (solid state). If the refrigerant changes to a solid state while in the intended charging space, the trailing refrigerant flowing into the intended charging space will be obstructed by the solidified refrigerant and the time until the charging is completed will increase, or more time will elapse after charging until the operation can recommence (until the solid state refrigerant dissolves).

In order to solve the aforedescribed problems, according to the refrigerant charging method of the second aspect, a cooling step is provided before the refrigerant charging (moving) step. In the cooling step, a container that supplies the refrigerant to the space in the refrigeration device intended to be charged by the refrigerant is cooled to 31° C. or below. As a result, the refrigerant inside the cylinder will not reach the supercritical state, and will be in a liquid phase or gas phase. Moreover, the refrigerant that is in a gas phase inside the container will first be caused to move into the space intended to be charged by the refrigerant; therefore, it will be substantially impossible for the refrigerant to change to the solid state even if the intended charging space is in a vacuum state and the refrigerant experiences an abrupt drop in pressure. Refrigerant that is in a liquid phase will similarly not change to a solid state in the space intended to be charged by the refrigerant because the refrigerant that is in a liquid phase inside the cylinder will enter the intended charging space after the refrigerant that is in a gas phase inside the container has entered the intended charging space and the pressure therein has risen to some extent.

Thus, according to the refrigerant charging method of the second aspect, it is possible to prevent the incidence of circumstances under which refrigerant that has entered the intended charging space from the container changes into a solid state during the charging process, and to minimize the incidence of faults related to, e.g., the solid-state refrigerant becoming an obstruction, as well as an increase in the charging time or the time following refrigerant charging until operation recommences.

In the cooling step, the container may be cooled using cooling water, or, when the surrounding atmospheric temperature is low, the container may be cooled using ambient air (including the time until the container reaches 31° C. or lower).

According to the refrigerant charging method of another aspect, heating means is provided between a refrigerant container and the space intended to be charged by the refrigerant, and the refrigerant is heated using the heating means, causing the specific enthalpy of the refrigerant to be 430 kJ/kg or higher when it enters the intended charging space. According to this method, even if the refrigerant inside the high-temperature cylinder is in a supercritical state, it is possible to prevent the refrigerant changing into a solid state during the charging process due to the pressure sharply decreasing, and to minimize the incidence of faults related to, e.g., the solid-state refrigerant (dry ice) becoming an obstruction, as well as an increase in the charging time or the time following refrigerant charging until operation recommences.

A refrigerant charging method according to yet another aspect is a refrigerant charging method for a refrigeration device in which carbon dioxide is used as a refrigerant, the method comprising a connecting step and a refrigerant charging step. In the connecting step, a container containing the refrigerant is connected to a space in the refrigeration device that is intended to be charged by refrigerant, heating means being interposed therebetween. In the refrigerant charging step, the refrigerant is moved from the container to the intended charging space, via the heating means. In the refrigerant charging step, furthermore, the refrigerant that has exited the container is heated by the heating means so that a specific enthalpy of the refrigerant when entering the intended charging space will be 430 kJ/kg or higher.

Refrigeration devices such as a hot-water-supplying device having a refrigeration cycle in which a carbon dioxide refrigerant is used are currently charged with the refrigerant at a manufacturing plant belonging to a manufacturer. However, refrigeration devices such as office air conditioners are not charged with carbon dioxide refrigerant at the locations at which the devices are installed. In other words, at present, carbon dioxide refrigerants are only widely used in refrigeration devices that are not charged at the installation location; the only refrigeration devices sold commercially have been completely charged with the refrigerant at the manufacturing site. At present, hot-water-supplying devices and other refrigeration devices having carbon dioxide refrigerants are not mass-produced, and there is little demand to reduce the time required to perform the refrigerant charging task to facilitate mass production.

However, the refrigerant charging task needs to be optimized and efficient in instances such as when the use of a carbon dioxide refrigerant is considered for application in commercial air conditioners or other refrigeration devices where it is common for interconnecting refrigerant piping for connecting indoor and outdoor units to be fitted in the buildings where the device is installed, and charging of the refrigerant to be performed on-site; or when refrigeration devices are mass-produced at a production site.

Therefore, the present inventors conducted a variety of investigations into charging refrigeration devices with a carbon dioxide refrigerant. First, when the refrigerant is to be charged into the intended charging space of a refrigeration device having carbon dioxide as a refrigerant, in some instances the amount of heat held by the refrigerant will cause the pressure to decrease sharply, whereby the refrigerant will change into a "dry ice" state (solid state). Specifically, when the specific enthalpy of the refrigerant when entering the intended charging space is less than 430 kJ/kg, an abrupt drop in the pressure can cause the refrigerant to change to a solid state. If the refrigerant changes to a solid state while in the intended charging space, the trailing refrigerant flowing into the space will be obstructed by the solidified refrigerant and the time until the charging is completed will increase, or more time will elapse after charging until the operation can recommence (until the solid state refrigerant dissolves).

In order to solve the aforedescribed problems, according to the refrigerant charging method of the above aspect, heating means is provided between a refrigerant container and the space intended to be charged by the refrigerant, and the refrigerant is heated using the heating means, causing the specific enthalpy of the refrigerant to be 430 kJ/kg or higher when it enters the intended charging space. According to this method, even if the refrigerant inside the high-temperature cylinder is in a supercritical state, it is possible to prevent the refrigerant changing into a solid state during the charging process due to the pressure sharply decreasing, and to minimize the incidence of faults related to, e.g., the solid-state refrigerant (dry ice) becoming an obstruction, as well as an increase in the charging time or the time following refrigerant charging until operation recommences.

The heating means is a hose or piping connecting a cylinder or other container containing high-pressure refrigerant to a space intended to be charged by the refrigerant in refrigerant piping or another part of a refrigeration device. As long as the heating means can heat the refrigerant that flows therethrough, the heating means may be piping having an attached heater, or an uninsulated hose or piping through which the heat of the outside air is transferred to the refrigerant. Having the hose connecting the cylinder or other container and the space intended to be charged by the refrigerant extended but kept free of insulation makes it possible for the hose to be used as the heating means, as is particularly so in an environment where the temperature of the surrounding atmosphere exceeds 31° C., which is the critical temperature of carbon dioxide.

The refrigerant charging method according to yet another aspect is a method wherein, in the refrigerant charging step, the refrigerant that has exited the container is heated by the heating means so that the temperature and pressure of the refrigerant when entering the intended charging space will be values that exceed those on a boundary line passing through points 1 to 5. The first point is the point at a temperature of 0° C. and a pressure of 3.49 MPa, the second point is the point at a temperature of 10° C. and a pressure of 4.24 MPa, the third point is the point at a temperature of 20° C. and a pressure of 5.07 MPa, the fourth point is the point at a temperature of 30° C. and a pressure of 6.00 MPa, and the fifth point is the point at a temperature of 40° C. and a pressure of 7.06 MPa.

The refrigerant that has exited the container is heated by the heating means so that the temperature and pressure of the refrigerant when entering the intended charging space will be values that exceed those on the boundary line passing through points 1 to 5. Therefore, the specific enthalpy of the refrigerant when entering the intended charging space will be 430 kJ/kg or higher, and the refrigerant will not change to a solid state while in the space targeted for charging by refrigerant.

According to the refrigerant charging method of the first and second aspects, it is possible to prevent the incidence of circumstances under which refrigerant that has entered the intended charging space from the container changes into a solid state during the charging process, and to minimize the incidence of faults related to, e.g., the solid-state refrigerant becoming an obstruction, as well as an increase in the charging time or the time following refrigerant charging until operation recommences.

According to the refrigerant charging method of the other aspects, even if the refrigerant inside the high-temperature cylinder is in a supercritical state, it is possible to prevent the refrigerant changing into a solid state during the charging process due to the pressure sharply decreasing, and to minimize the incidence of faults related to, e.g., the solid-state refrigerant becoming an obstruction, as well as an increase in the charging time or the time following refrigerant charging until operation recommences.

DETAILED DESCRIPTION

In a refrigeration cycle having carbon dioxide used as a refrigerant, the refrigerant charging method according to the present invention is a method for supplying the refrigerant from a cylinder or another container in which the refrigerant is contained to a space intended to be charged by the refrigerant within the refrigeration cycle, and for efficiently charging the intended charging space with the necessary amount of refrigerant. First, a brief description shall be provided of the refrigeration cycle to be charged with refrigerant using the refrigerant charging method, after which a description shall be provided of a refrigerant charging method according to a first embodiment and a refrigerant charging method according to a second embodiment.

Refrigeration Cycle

Figure 1:
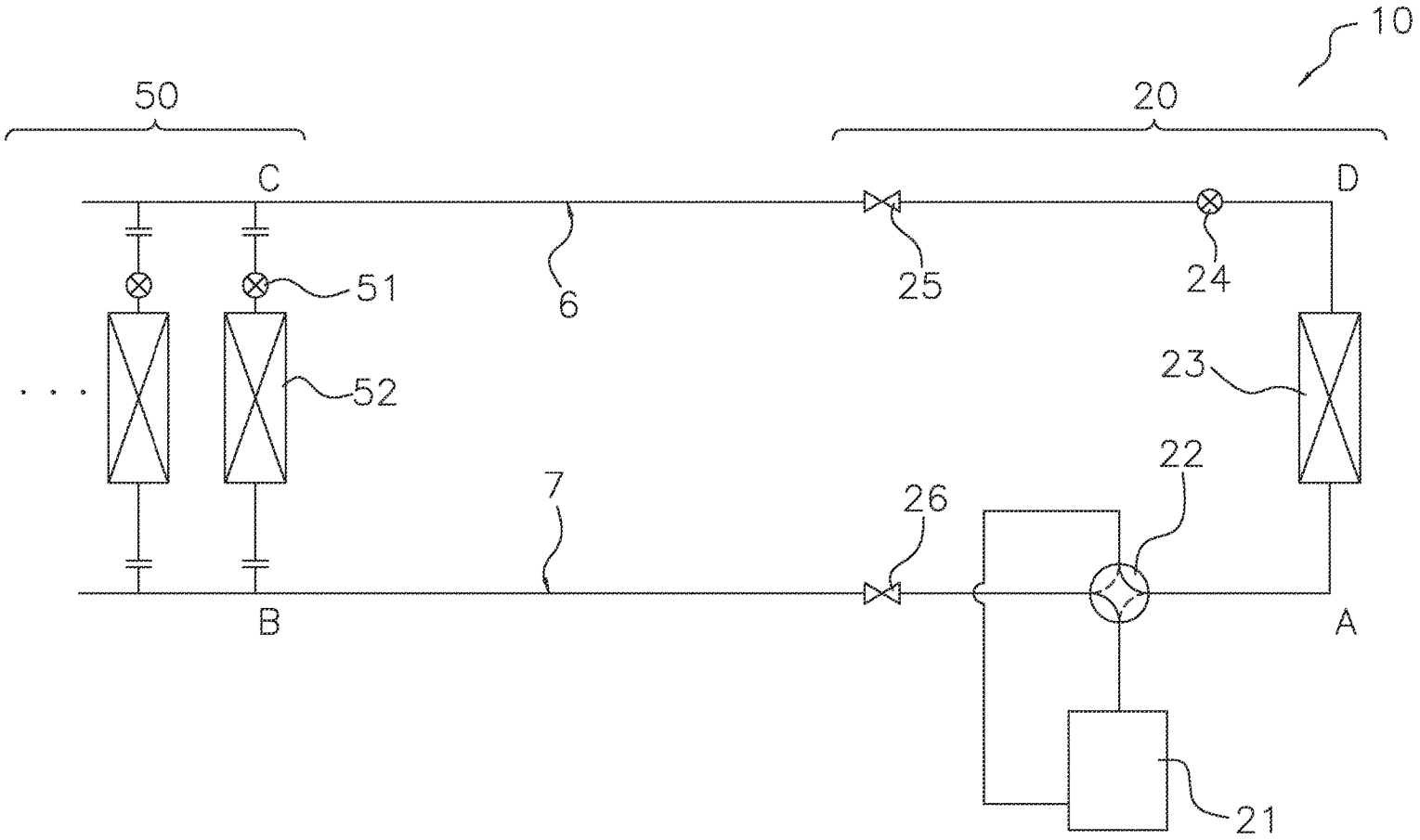
FIG. 1 is a diagram showing a refrigeration cycle of an air conditioning device.

FIG. 1 is drawing of a refrigeration cycle of an air conditioning device 10 in which carbon dioxide is used as a refrigerant (hereinafter referred to as $CO_2$ refrigerant). The air conditioning device 10 is a multiple-unit air conditioning device installed in an office building or similar structure, and is used for cooling or heating a plurality of spaces, the device having a plurality of indoor units 50 linked to a single outdoor unit 20. The air conditioning device 10 comprises the outdoor unit 20, the plurality of indoor units 50, and interconnecting refrigerant piping 6, 7 for connecting the units 20, 50. The outdoor unit 20 has a compressor 21, a four-way switching valve 22, an outdoor heat exchanger 23, an outdoor expansion valve 24, closing valves 25, 26, and other components; and is brought into the building in a state of having been charged with $CO_2$ refrigerant in advance. Each of the indoor units 50 has an indoor expansion valve 51 and an indoor heat exchanger 52, is installed in the ceiling or other region of each open space (rooms or the like) inside the building, and is connected to the outdoor unit via the interconnecting refrigerant piping 6, 7, which are fitted on-site. Fitting the piping on-site to the outdoor unit 20 and the indoor units 50 brought into the building thus forms a single refrigeration cycle.

As shown in FIG. 1, the refrigeration cycle of the air conditioning device 10 is a closed circuit in which the compressor 21, the four-way switching valve 22, the outdoor heat exchanger 23, the outdoor expansion valve 24, each indoor expansion valve 51, and each indoor heat exchanger 52 are linked by refrigerant piping that includes the interconnecting refrigerant piping 6, 7. After the refrigeration cycle has been formed on-site, $CO_2$ refrigerant is discharged and supplied from a cylinder to a space within the indoor units 50 and the interconnecting refrigerant piping 6, 7 (the space intended to be charged by the refrigerant). The refrigerant charging task will be described in more detail hereinafter.

When the refrigerant charging task has been completed and the refrigeration cycle has been charged with the necessary amount of $CO_2$ refrigerant, the air conditioning device 10 reaches a state in which heat exchange is performed between the $CO_2$ refrigerant flowing through the indoor heat exchangers 52 of the indoor units 50, and the air inside the rooms, whereby an air conditioning operation for cooling or heating the spaces inside the building can be performed.

The four-way switching valve 22 in the air conditioning device 10 is used to switch the direction in which the refrigerant flows, thereby making it possible to switch between a heating operation and a cooling operation.

During the cooling operation, the outdoor heat exchanger 23 becomes a gas cooler, and the indoor heat exchangers 52 become evaporators. During the heating operation, the outdoor heat exchanger 23 becomes an evaporator, and the indoor heat exchangers 52 become gas coolers.

In FIG. 1, point A is an inlet side of the compressor 21 during the heating operation, and point B is a discharge side of the compressor 21 during the heating operation. Point C is a refrigerant outlet of the indoor heat exchangers 52 during the heating operation, and point D is a refrigerant entrance of the outdoor heat exchanger 23 during the heating operation.

Figure 2:
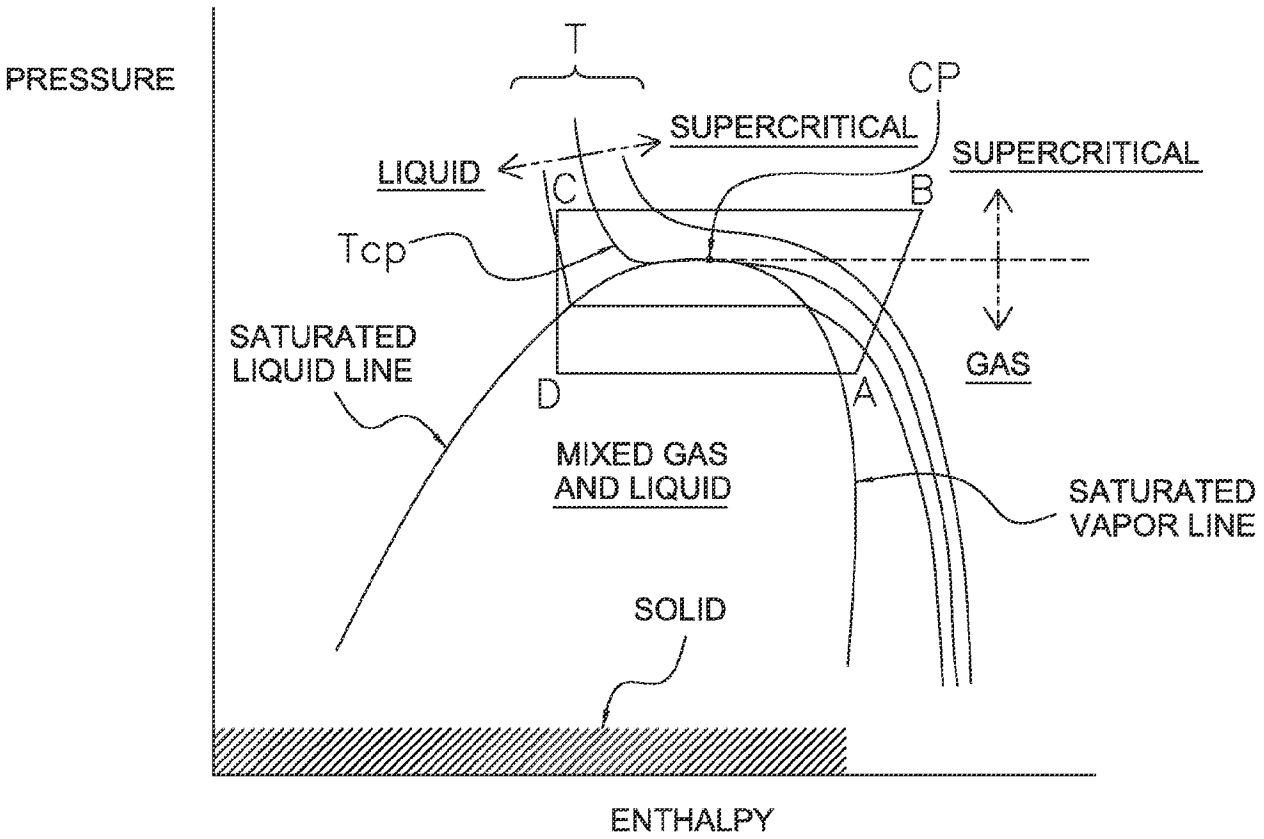
FIG. 2 is a simplified schematic diagram showing pressure and enthalpy states of a $CO_2$ refrigerant.

FIG. 2 is a diagram used to express a pressure-enthalpy state of the $CO_2$ refrigerant in a simplified manner, wherein the vertical axis shows the pressure and the horizontal axis shows the enthalpy. Tcp is a constant temperature line that passes through a critical point CP. In the region that is to the right of the isotherm Tcp and is at or above the critical pressure, which is the pressure at the critical point CP, the $CO_2$ refrigerant enters a supercritical state, wherein the $CO_2$ refrigerant becomes a fluid simultaneously exhibiting diffusibility, which is a characteristic of a gas, and solubility, which is a characteristic of a liquid. The air conditioning device 10 operates using a refrigeration cycle that includes the supercritical state, as shown by the bold line in FIG. 2. In the refrigeration cycle for the heating operation, the $CO_2$ refrigerant is compressed by the compressor 21 up to a pressure that exceeds the critical pressure, cooled to a liquid by the indoor heat exchanger 52, decompressed at the outdoor expansion valve 24, evaporated in the outdoor heat exchanger 23, becomes a gas, and is once more drawn into the compressor 21.

Refrigerant Charging Method According to the First Embodiment

The outdoor unit 20 and the indoor units 50 are connected using the interconnecting refrigerant piping 6, 7, which is fitted on-site. After a single closed refrigeration cycle has been formed therefrom, the refrigerant charging task is performed.

Figure 3:
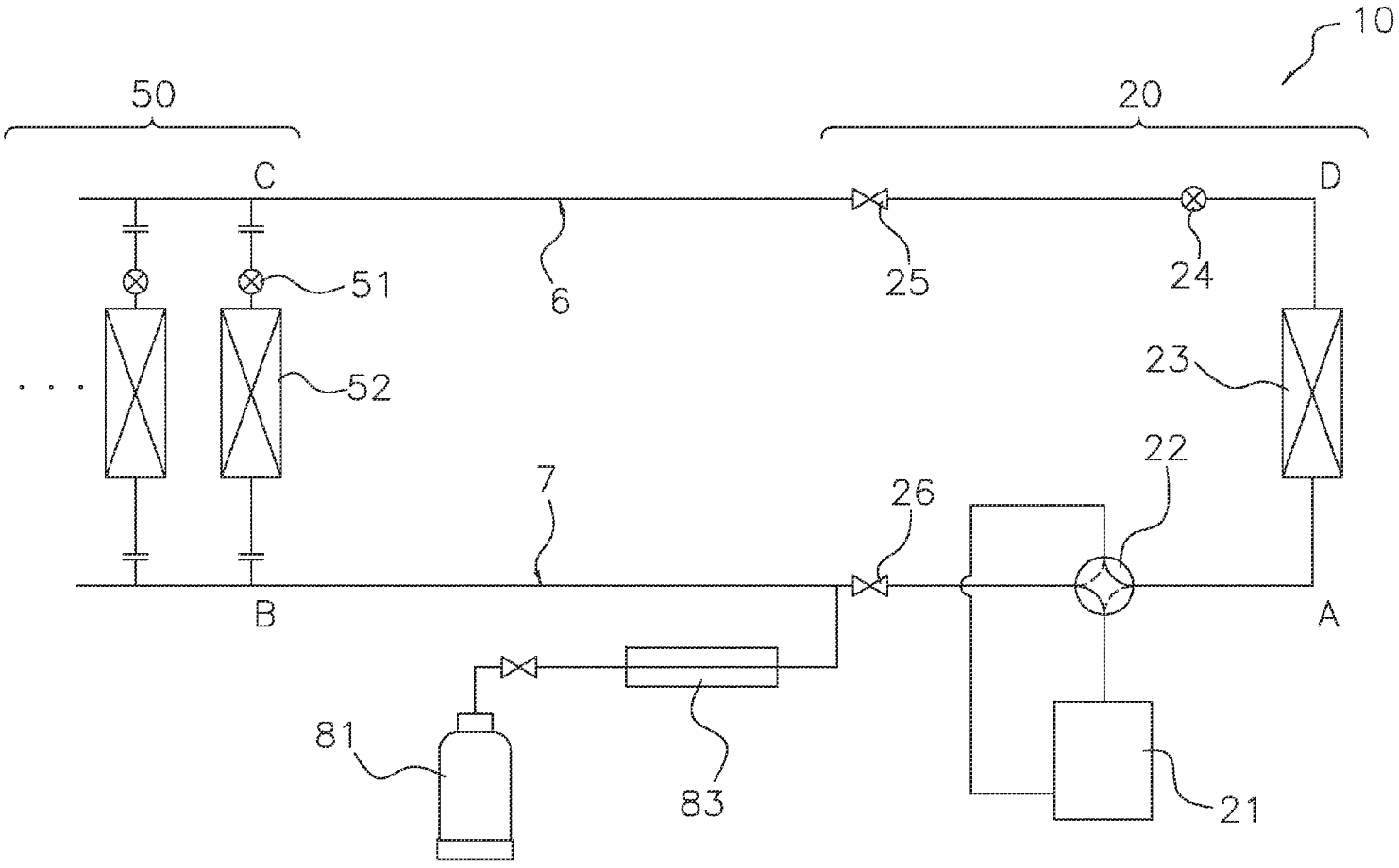
FIG. 3 is a diagram showing a state wherein a refrigerant charging cylinder is connected to the refrigeration cycle of the air conditioning device.

In the refrigerant charging method according to the first embodiment, first, the interior of the indoor units 50 and the interconnecting refrigerant piping 6, 7 is evacuated (brought to extremely low pressure) using a vacuum pump or the like (not shown). Next, as shown in FIG. 3, a cylinder 81 containing $CO_2$ refrigerant is connected to a charge port installed near the closing valve 26 of the outdoor unit 20. There is attached to the piping connecting the cylinder 81 and the charge port a heater 83 for heating the piping and the $CO_2$ refrigerant that flows through the interior thereof. Next, the heater 83 is activated so that the specific enthalpy of the $CO_2$ refrigerant having entered the interconnecting refrigerant piping 7 from the charge port will reach 430 kJ/kg or higher, and refrigerant charging will be performed. Specifically, the heater 83 is activated so that the temperature and pressure of the $CO_2$ refrigerant having entered the interconnecting refrigerant piping 7 will fall in the area on the higher [value] side of the line connecting the five points P1 to P5 shown in FIG. 4. Point P1 is the point at a temperature of 0° C. and a pressure of 3.49 MPa, point 2 is the point at a temperature of 10° C. and a pressure of 4.24 MPa, point 3 is the point at a temperature of 20° C. and a pressure of 5.07 MPa, point 4 is the point at a temperature of 30° C. and a pressure of 6.00 MPa, and point 5 is the point at a temperature of 40° C. and a pressure of 7.06 MPa.

Thus, when the refrigerant charging task is initiated, there will be no incidence of any fault related to, the $CO_2$ refrigerant in the interconnecting refrigerant piping 7 changing to a solid and obstructing the flow of the trailing $CO_2$ refrigerant.

Figure 4:
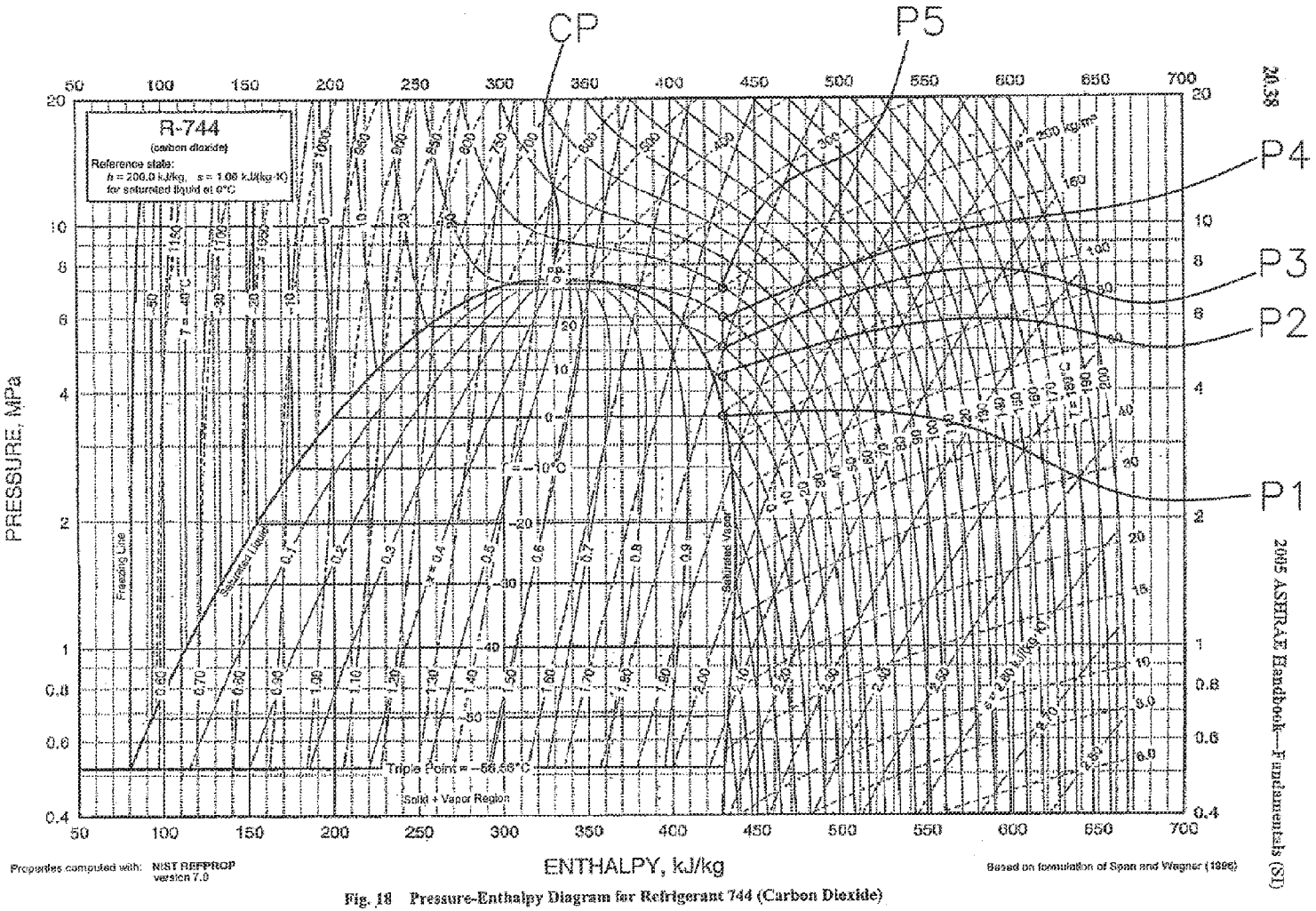
FIG. 4 is a detailed diagram showing pressure and enthalpy states of a $CO_2$ refrigerant (created with reference to Fundamentals: 2005 ASHRAE Handbook: SI Edition).

Specifically, as shown in the pressure-enthalpy state diagram for carbon dioxide shown in FIGS. 2 and 4, when the specific enthalpy is less than 430 kJ/kg, the $CO_2$ refrigerant in the state recorded on the right side of the isotherm Tcp that passes through the critical point CP of carbon dioxide (critical temperature: approximately 31° C., critical pressure: approximately 7.3 MPa) will shift to the shaded area in FIG. 2 (in FIG. 4, the area in which the pressure is at or below approximately 0.5 MPa and the specific enthalpy is less than 430 kJ/kg) when an abrupt drop in pressure occurs, and will change to a solid state. In order to prevent this, the $CO_2$ refrigerant that has exited the cylinder 81 is heated by the heater 83 so that the specific enthalpy of the $CO_2$ refrigerant will reach 430 kJ/kg or higher. As a result, no matter how abruptly the pressure may drop when the $CO_2$ refrigerant enters the interconnecting refrigerant piping 7, the $CO_2$ refrigerant will not change to a solid state, because as long as the specific enthalpy is 430 kJ/kg or higher, carbon dioxide will not change to a solid (see FIG. 4).

As described above, in the refrigerant charging method according to the first embodiment, the specific enthalpy of the $CO_2$ refrigerant is brought to 430 kJ/kg or higher at the time the $CO_2$ refrigerant enters the evacuated space intended to be charged (the interior space of the indoor units 50 and the interconnecting refrigerant piping 6, 7), there will be no incidence of faults related to, e.g., the $CO_2$ refrigerant in the interconnecting refrigerant piping 7 changing to a solid near the charge port and obstructing the flow of the trailing $CO_2$ refrigerant, or long periods of time elapsing after charging until the air conditioning device 10 can be operated.

Modification of the First Embodiment

In the above described refrigerant charging method, a heater 83 is attached to the piping between the cylinder 81 and the charge port; however, in place of installing the heater 83, it is possible to adopt a method involving lengthening the piping between the cylinder 81 and the charge port. It is possible for the long piping between the cylinder 81 and the charge port to not have an insulation material or the like wrapped therearound, and for heat in the air surrounding to be used to heat the $CO_2$ refrigerant flowing through the piping. Even in such cases, as long as the specific enthalpy of the $CO_2$ refrigerant when the $CO_2$ refrigerant enters the intended charging space can be kept in a state of being 430 kJ/kg or higher, there will be no incidence of faults related to, e.g., the $CO_2$ refrigerant changing to a solid near the charge port and obstructing the flow of the trailing $CO_2$ refrigerant, or long periods of time elapsing after charging until the air conditioning device 10 can be operated.

Refrigerant Charging Method According to the Second Embodiment

The outdoor unit 20 and the indoor units 50 are connected using the interconnecting refrigerant piping 6, 7, which is fitted on-site. After a single closed refrigeration cycle has been formed therefrom, the refrigerant charging task is performed. A description will be given with reference to FIG. 3; however, in a case in which the refrigerant charging method according to a second embodiment is employed, the heater 83 shown in FIG. 3 will be unnecessary.

In the refrigerant charging method according to the second embodiment, first, the interiors of the indoor units 50 and the interconnecting refrigerant piping 6,7 are evacuated (brought to extremely low pressure) using a vacuum pump or the like (not shown). Next, a cylinder 81 containing $CO_2$ refrigerant is connected to a charge port installed near the closing valve 26 of the outdoor unit 20. When the cylinder 81 is at a temperature in excess of 31° C. before or after being connected, the cylinder 81 is cooled so as to bring the temperature of the $CO_2$ refrigerant inside the cylinder 81 to 31° C. or below. Specifically, the cylinder 81 is cooled using cooling water or another medium (not shown). Once it has been confirmed that the temperature of the cylinder 81 has reached 31° C. or below, the $CO_2$ refrigerant in a gas phase (gaseous state) within the cylinder 81 is discharged and supplied into the space intended to be charged by the refrigerant (the space within the indoor unit 50 and the interconnecting refrigerant piping 6, 7). Once the gaseous-state $CO_2$ refrigerant has been supplied, the $CO_2$ refrigerant in a liquid phase (liquid state) within the cylinder 81 is discharged and supplied into the intended charging space.

Thus, when the refrigerant charging task is initiated, there will be no incidence of any fault related to, e.g., the $CO_2$ refrigerant in the interconnecting refrigerant piping 7 changing to a solid and obstructing the flow of the trailing ($CO_2$ refrigerant.

Specifically, as shown in the pressure-enthalpy state diagram for carbon dioxide shown in FIGS. 2 and 4, when the specific enthalpy is less than 430 kJ/kg, the $CO_2$ refrigerant in the state recorded on the right side of the isotherm Tcp that passes through the critical point CP of carbon dioxide (critical temperature: approximately 31° C., critical pressure: approximately 7.3 MPa) will shift to the shaded area in FIG. 2 (in FIG. 4, the area in which the pressure is at or below approximately 0.5 MPa and the specific enthalpy is less than 430 kJ/kg) when an abrupt drop in pressure occurs, and will change to a solid state. In order to prevent such a change, therefore, the cylinder 81 is cooled to 31° C. or below, before refrigerant charging is performed. As a result, the refrigerant inside the cylinder 81 will not reach the supercritical state, and will be in a liquid phase or gas phase. Moreover, the $CO_2$ refrigerant that is in a gas phase inside the container 81 will first be caused to move into the space intended to be charged by the refrigerant; therefore, it will be substantially impossible for the refrigerant to change to the solid state even if the intended charging space is in a vacuum state and the $CO_2$ refrigerant experiences an abrupt drop in pressure. $CO_2$ refrigerant that is in a liquid phase will similarly not change to a solid state in the space intended to be charged by the refrigerant because the refrigerant that is in a liquid phase inside the cylinder 81 will enter the intended charging space after the $CO_2$ refrigerant that is in a gas phase inside the cylinder 81 has entered the space and the pressure therein has risen to some extent.

As described above, in the refrigerant charging method according to the second embodiment, there will be substantially no incidence of any fault related to, e.g., the $CO_2$ refrigerant changing to a solid near the charge port and obstructing the flow of the trailing $CO_2$ refrigerant, or long periods of time elapsing after charging until the air conditioning device 10 can be operated.

Modification of the Second Embodiment

In the above described refrigerant charging method, cold water or another medium is used for cooling the cylinder 81; however, when the atmospheric temperature surrounding the cylinder 81 is low, it is possible to employ a method involving waiting for the temperature of the cylinder 81 to unassistedly reach 31° C. or below. In this case as well, the temperature of the $CO_2$ refrigerant inside the cylinder 81 decreases, and as long as the $CO_2$ refrigerant that is in a gas phase discharges first among the liquid- and gas-phase $CO_2$ refrigerant into the space intended to be charged by the refrigerant, there will be substantially no incidence of any fault related to, e.g., the $CO_2$ refrigerant changing to a solid near the charge port and obstructing the flow of the trailing $CO_2$ refrigerant, or long periods of time elapsing after charging until the air conditioning device 10 can be operated.

Application of Refrigerant Charging Method to Other Refrigeration Devices (1) In the abovementioned air conditioning device 10, the outdoor unit 20 that is charged in advance with $CO_2$ refrigerant at the manufacturing plant or another production site belonging to a manufacturer is brought on-site (to the building), and the refrigerant is charged into the space within the indoor units 50 and the interconnecting refrigerant piping 6, 7 on-site. However, it is also possible to use the refrigerant charging method according to the present invention in cases in which all of the refrigerant charging is performed on-site. It is also possible to use the refrigerant charging method according to the present invention when the outdoor unit 20 is charged with refrigerant at the manufacturing plant or other production site.

(2) It is also possible to use the refrigerant charging method according to the present invention for refrigeration devices other than the multi-split type air conditioning device 10. For example, using the refrigerant charging method according to the present invention makes it possible to reduce the amount of time necessary for the refrigerant charging task even in heat pump hot-water-supplying devices in which the refrigeration cycle is completed and also the refrigerant is charged in a manufacturing plant or another production site belonging to a manufacturer.

What is claimed is:

1. A refrigerant charging method, comprising:

installing on site a refrigeration device having an indoor unit and an outdoor unit and having carbon dioxide used as a refrigerant, the indoor unit and the outdoor unit being connected using interconnecting piping, and the refrigerant being subsequently charged on-site into the refrigeration device;

checking if a container is at a temperature in excess of 31° C.;

if the container is at a temperature in excess of 31° C. when checked, cooling the container to 31° C. or below using a cooling medium, the container containing the refrigerant and being configured to supply the refrigerant to a space in the refrigeration device intended to be charged by the refrigerant, confirming that the container has reached 31° C. or below, and moving the refrigerant to the intended charging space from the container upon confirming that the container has reached 31° C. or below via the cooling step; and if the container is not at a temperature in excess of 31° C. when checked, moving the refrigerant to the intended charging space from the container upon confirming that the container is at a temperature of 31° C. or below, when moving the refrigerant from the container to the intended charging space, first, refrigerant that is in a gas phase within the container is moved into the intended charging space, whereupon refrigerant that is in a liquid phase within the container is moved into the intended charging space.

2. A refrigerant charging method for a refrigeration device, comprising:

checking if a container is at a temperature in excess of 31° C.;

if the container is at a temperature in excess of 31° C. when checked, cooling the container to 31° C. or below using a cooling medium, the container containing a carbon dioxide refrigerant and being configured to supply the refrigerant to a space in the refrigeration device intended to be charged by the refrigerant, confirming that the container has reached 31° C. or below, and moving the refrigerant to the intended charging space from the container upon confirming that the container has reached 31° C. or below via the cooling step; and if the container is not at a temperature in excess of 31° C. when checked, moving the refrigerant to the intended charging space from the container upon confirming that the container is at a temperature of 31° C. or below, when moving the refrigerant from the container to the intended charging space, first, refrigerant that is in a gas phase within the container is moved into the intended charging space, whereupon refrigerant that is in a liquid phase within the container is moved into the intended charging space.

* * * * *